US010995556B2

(12) United States Patent
Samuel et al.

(10) Patent No.: US 10,995,556 B2
(45) Date of Patent: May 4, 2021

(54) DRILL BITS WITH STICK-SLIP RESISTANCE

(71) Applicant: Halliburton Energy Services, Inc., Houston, TX (US)

(72) Inventors: Robello Samuel, Cypress, TX (US); Mark Evans Williams, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/895,796

(22) Filed: Jun. 8, 2020

(65) Prior Publication Data

US 2020/0300043 A1 Sep. 24, 2020

Related U.S. Application Data

(62) Division of application No. 14/809,935, filed on Jul. 27, 2015, now Pat. No. 10,738,537.

(60) Provisional application No. 62/041,319, filed on Aug. 25, 2014.

(51) Int. Cl.

| | |
|---|---|
| ***E21B 10/00*** | (2006.01) |
| ***E21B 7/24*** | (2006.01) |
| ***E21B 10/42*** | (2006.01) |

(52) U.S. Cl.

CPC ..... *E21B 10/00* (2013.01); *E21B 7/24* (2013.01); *E21B 10/42* (2013.01)

(58) Field of Classification Search

CPC ..... E21B 1/00; E21B 7/24; E21B 10/36

See application file for complete search history.

(56) References Cited

U.S. PATENT DOCUMENTS

| | | | |
|---|---|---|---|
| 4,243,112 | A | 1/1981 | Sartor |
| 4,518,888 | A | 5/1985 | Zabcik |
| 5,115,880 | A | 5/1992 | Sallas et al. |
| 5,231,325 | A | 7/1993 | Tamai et al. |
| 5,345,137 | A | 9/1994 | Funakubo et al. |
| 6,279,670 | B1 | 8/2001 | Eddison et al. |
| 6,392,327 | B1 | 5/2002 | Lewis et al. |
| 6,508,317 | B2 | 1/2003 | Eddison et al. |
| 6,998,999 | B2 | 2/2006 | Fripp et al. |
| 8,286,735 | B1 | 10/2012 | Cooley et al. |
| 8,316,964 | B2 | 11/2012 | Hall et al. |
| 8,534,380 | B2 | 9/2013 | Sheppard et al. |
| 8,714,005 | B2 | 5/2014 | Vetter |
| 9,663,995 | B2 * | 5/2017 | Jain ..... E21B 17/1092 |
| 2004/0007387 | A1 | 1/2004 | Bar-Cohen et al. |
| 2007/0029111 | A1 | 2/2007 | Chen |

(Continued)

FOREIGN PATENT DOCUMENTS

| | | |
|---|---|---|
| CA | 2348554 | 11/2001 |

OTHER PUBLICATIONS

Notice of Allowance for U.S. Appl. No. 14/809,935 dated Apr. 10, 2020.

(Continued)

*Primary Examiner* — Steven A MacDonald

(74) *Attorney, Agent, or Firm* — Benjamin Ford; C. Tumey Law Group PLLC

(57) ABSTRACT

A drill bit includes a bit body and one or more cutters positioned on the bit body at select locations. At least one vibrational device is positioned on the bit body to impart vibration to the bit body and thereby mitigate stick-slip.

20 Claims, 7 Drawing Sheets

(56) References Cited

U.S. PATENT DOCUMENTS

| | | | | |
|---|---|---|---|---|
| 2013/0068525 | A1 | 3/2013 | DiGiovanni | |
| 2013/0200756 | A1 | 8/2013 | Maki, Jr. | |
| 2014/0238662 | A1 | 8/2014 | Prieto | |
| 2014/0311801 | A1* | 10/2014 | Jain | E21B 10/42 175/27 |
| 2014/0345948 | A1 | 11/2014 | Cheng | |
| 2015/0361790 | A1 | 12/2015 | Ferrara et al. | |
| 2016/0053544 | A1 | 2/2016 | Ludewigt | |
| 2017/0022762 | A1 | 1/2017 | Larsen et al. | |

OTHER PUBLICATIONS

Final Office Action for U.S. Appl. No. 14/809,935 dated Mar. 3, 2020.
Final Office Action for U.S. Appl. No. 14/809,935 dated Mar. 14, 2019.
Final Office Action for U.S. Appl. No. 14/809,935 dated Jun. 18, 2018.
Final Office Action for U.S. Appl. No. 14/809,935 dated Sep. 12, 2019.
Office Action for U.S. Appl. No. 14/809,935 dated Jan. 2, 2020.
Office Action for U.S. Appl. No. 14/809,935 dated Mar. 19, 2018.
Office Action for U.S. Appl. No. 14/809,935 dated May 29, 2019.
Office Action for U.S. Appl. No. 14/809,935 dated Sep. 14, 2018.

* cited by examiner

DRILL BITS WITH STICK-SLIP RESISTANCE

CROSS-REFERENCE TO RELATED APPLICATIONS

The present application is a divisional of U.S. patent application Ser. No. 14/809,935, entitled "DRILL BITS WITH STICK-SLIP RESISTANCE," filed on Jul. 27, 2015, which claims the benefit of U.S. Provisional Application No. 62/041,319, entitled "DRILL BITS WITH STICK-SLIP RESISTANCE" and filed Aug. 25, 2014, the disclosures of which are incorporated herein by reference for all purposes.

BACKGROUND

Wellbores are formed in subterranean formations for various purposes including, for example, the extraction of oil and gas and the extraction of geothermal heat. Such wellbores are typically formed using one or more drill bits, such as fixed-cutter bits (sometimes referred to in the art as polycrystalline diamond compact or PDC bits), rolling-cutter bits (sometimes referred to in the art as "rock" bits), diamond-impregnated bits, and hybrid bits, which may include, for example, both fixed cutters and rolling cutters. The drill bit is coupled either directly or indirectly to an end of a drill string or work string, which encompasses a series of elongated tubular segments connected end-to-end that extends into the wellbore from the surface. Drilling is a process of forming the wellbore by rotating the drill bit so that its cutters or abrasive structures cut, crush, shear, and/or abrade away the formation materials.

Various non-ideal drill string behaviors can occur while drilling due to the complex dynamic behavior of the drill string and its interaction with the formation being drilled. One such mode of undesirable drill string behavior is known as stick-slip. During drilling, the drill string can be elastically twisted (i.e. torsionally flexed without appreciable yielding), up to several full 360-degree revolutions, while the drill bit temporarily sticks due to friction between the drill bit and the formation. Torsion in the drill string builds to an excessive value that eventually frees the drill bit, causing the freed drill bit to rotate violently with an angular velocity that is temporarily much higher than the angular velocity measured at the surface. Stick-slip causes excessive and unwanted vibrations for a drill string in the torsional direction, along with excessive drill bit speeds, which can lead to premature bit wear or failure of the drill bit or other drill string components.

Another mode of undesirable drill string behavior is known as "bit whirl." During drilling, the intended rotational motion of the drill string is around its own central axis. Bit whirl is an additional bulk rotation of the drill string, which is eccentric or precessing rotation of the drill string offset from the wellbore axis. This additional bulk rotation can be induced due to bending forces on the drill string in combination with the spinning rotation of the drill string about its own axis. Whirling motion can occur in the same direction as the rotation of the drill string (forward whirl) or in the opposite direction (backward whirl). Backward whirl is known to be a particularly strong cause of PDC (polycrystalline diamond compact) drill bit failures and of lower performance of PDC drill bits.

Efforts to reduce or eliminate unwanted drill string behavior such as stick-slip and bit whirl include modeling drill string behavior to identify causes and solutions.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1:
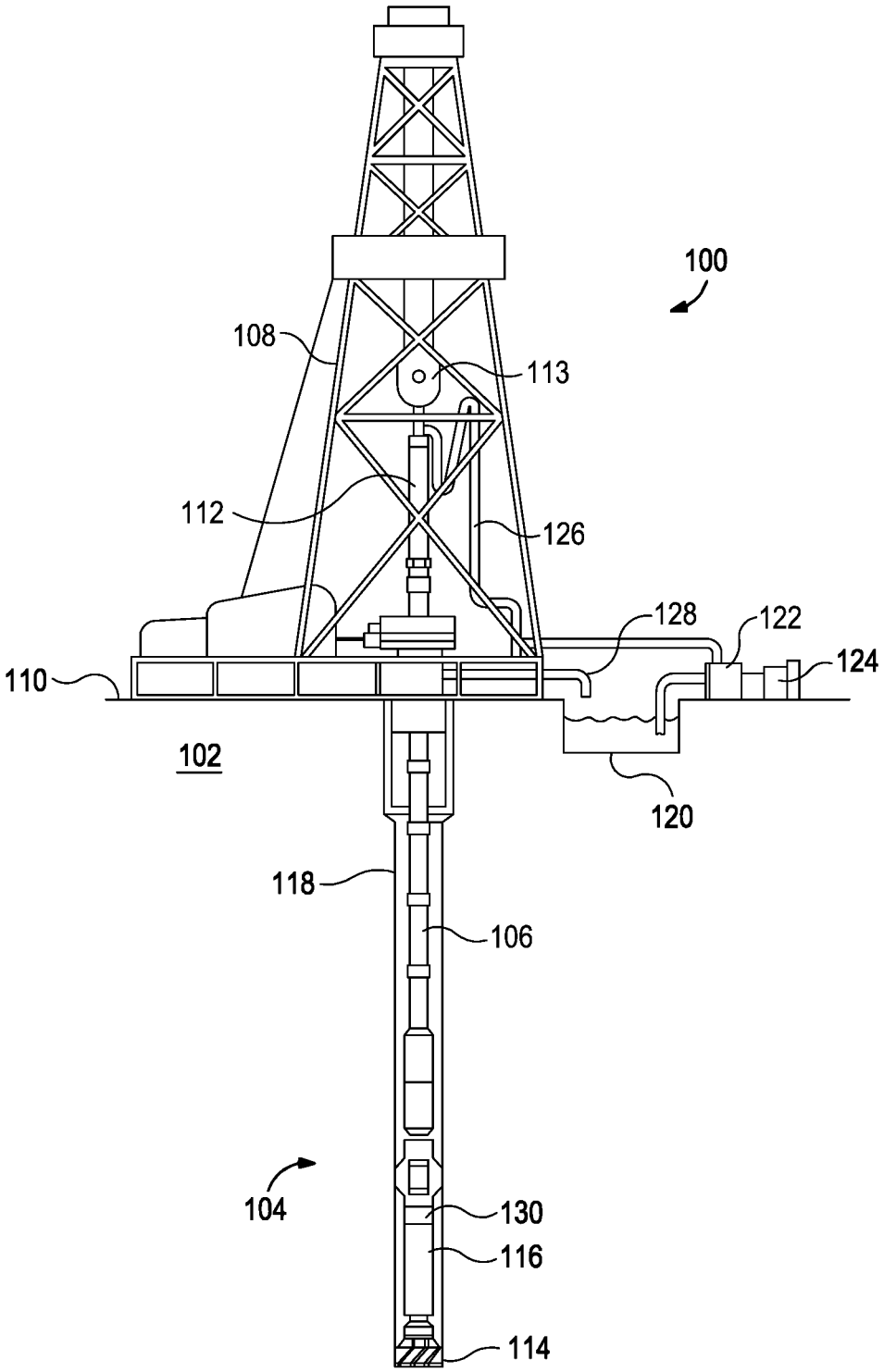
FIG. 1 depicts a drilling system that can employ the principles of the present disclosure.

The present disclosure is related to wellbore operations and, more particularly, to minimizing stick-slip and backward whirl while drilling wellbores.

According to embodiments of the present disclosure, one or more vibration inducing assemblies, such as integrated piezoceramic actuators, may be included in a bottom hole assembly (BHA) of a drill string and used to mitigate stick-slip and backward whirl of the drill string and associated drill bit. More particularly, piezoceramic actuators may be disposed at various locations about the periphery of a drill bit and operated to introduce "chattering" or vibrations in the drill bit of a very small displacement, but at a relatively high frequency. Suitable frequencies for operating the piezoceramic actuators, for example, may be in the range of several to several-hundred kilohertz. For example, vibrational devices such as piezoceramic actuators may be operated with a range of vibrational frequencies including, but not limited to, between 1 hertz (Hz) and 100 Hz, between 100 Hz and 1000 Hz, or between 100 Hz and 500 Hz. Applying vibrations to a drill bit at such frequencies may result, in one embodiment, in the drill bit continuously chattering (e.g., vibrating) such that the "stick" phase of the stick-slip phenomenon is mitigated and otherwise entirely prevented from occurring. In another embodiment, vibrations may be applied to or otherwise induced in a drill bit at a frequency tuned to counteract vibrations such as torsional vibrations that would otherwise be introduced into the drill string due to stick-slip and/or backward whirl, and thereby reducing the risk of damage and/or wear in the drill string. In yet other embodiments, very small displacement, high frequency modifications to the depth of cut of the drill bit may be introduced by employing vibrating depth of cut control (DOCC) devices in the drill bit.

It should be noted that the low-magnitude and high frequency chattering in various directions provided by the presently discussed integrated piezoceramic actuator(s), DOCC devices, and/or other vibrational devices disposed on or within a drill bit may help reduce stick-slip and/or backward whirl without harming the drill bit or the drill string since the resulting induced strain in the drill bit and the drill string by the small displacement vibrations is relatively small. In various embodiments, the amplitude and/or frequency of motion for each vibrational device and/or DOCC element may be controlled (and may vary) based on its position as mounted to the bit body.

In systems where the tendency for stiction for a particular application is high, or stiction is already in process for the particular application, the presently described piezoceramic actuators can be modified (prior to or real time during drilling) to operate in the ultrasonic range, thereby transforming the drilling system into an ultrasonic drilling machine. Vibrations induced in the drill bit in the ultrasonic range may cause the drill bit to break the rock in which it is embedded and further prevent stick-slip and/or break any occurring stiction.

In order to reduce the backward whirl of the drill bit and/or drill string, one or more vibration inducing devices such as piezoceramic actuators may be positioned and tuned to vibrate in the drill bit in a circumferential direction so that the intensity of backward whirl is reduced or otherwise eliminated. This may result in a high lateral contact area at very high frequency. The frequency of vibration may be determined based on an assumption that it is the response of the drill bit to forced motion off its center that causes whirl. One or more piezoceramic actuators may be operated to impart energy to the drill bit in, for example, the opposite direction of whirling to oppose the whirling motion. Providing a drill bit with vibrational devices as described herein may facilitate providing an anti-stick and/or anti-whirl drill bit, which results in generating the point loaded blade friction associated with drill bit movement.

Referring to FIG. 1, illustrated is an exemplary drilling system 100 that may employ one or more principles of the present disclosure. Boreholes may be created by drilling into the earth 102 using the drilling system 100. The drilling system 100 may be configured to drive a bottom hole assembly (BHA) 104 positioned or otherwise arranged at the bottom of a drill string 106 extended into the earth 102 from a derrick 108 arranged at the surface 110. The derrick 108 includes a kelly 112 and a traveling block 113 used to lower and raise the kelly 112 and the drill string 106.

The BHA 104 may include a drill bit 114 operatively coupled to a tool string 116 which may be moved axially within a drilled wellbore 118 as attached to the drill string 106. During operation, the drill bit 114 penetrates the earth 102 and thereby creates the wellbore 118. The BHA 104 provides directional control of the drill bit 114 as it advances into the earth 102. The tool string 116 can be semi-permanently mounted with various measurement tools (not shown) such as, but not limited to, measurement-while-drilling (MWD) and logging-while-drilling (LWD) tools, that may be configured to take downhole measurements of drilling conditions. In other embodiments, the measurement tools may be self-contained within the tool string 116, as shown in FIG. 1.

Fluid or "mud" from a mud tank 120 may be pumped downhole using a mud pump 122 powered by an adjacent power source, such as a prime mover or motor 124. The mud may be pumped from the mud tank 120, through a stand pipe 126, which feeds the mud into the drill string 106 and conveys the same to the drill bit 114. The mud exits one or more nozzles arranged in the drill bit 114 and in the process cools the drill bit 114. After exiting the drill bit 114, the mud circulates back to the surface 110 via the annulus defined between the wellbore 118 and the drill string 106, and in the process returns drill cuttings and debris to the surface. The cuttings and mud mixture are passed through a flow line 128 and are processed such that a cleaned mud is returned down hole through the stand pipe 126 once again.

Although the drilling system 100 is shown and described with respect to a rotary drill system in FIG. 1, those skilled in the art will readily appreciate that many types of drilling systems can be employed in carrying out embodiments of the disclosure. For instance, drills and drill rigs used in embodiments of the disclosure may be used onshore (as depicted in FIG. 1) or offshore (not shown). Offshore oil rigs that may be used in accordance with embodiments of the disclosure include, for example, floaters, fixed platforms, gravity-based structures, drill ships, semi-submersible platforms, jack-up drilling rigs, tension-leg platforms, and the like. It will be appreciated that embodiments of the disclosure can be applied to rigs ranging anywhere from small in size and portable, to bulky and permanent.

Further, although described herein with respect to oil drilling, various embodiments of the disclosure may be used in many other applications. For example, disclosed methods can be used in drilling for mineral exploration, environmental investigation, natural gas extraction, underground installation, mining operations, water wells, geothermal wells, and the like. Further, embodiments of the disclosure may be used in weight-on-packers assemblies, in running liner hangers, in running completion strings, etc., without departing from the scope of the disclosure.

The drilling system 100 may further include computing equipment, such as computing and communications components 130 (e.g., a computer processor or firmware, one or more logic devices, volatile or non-volatile memory, and/or communications components such as antennas, communications cables, radio-frequency front end components, etc.). In some embodiments, the computing and communications components 130 may be included in the BHA 104, as illustrated. In other embodiments, however, the computing and communications components 130 may be provided at the surface and communicably coupled to the BHA 104 via known telecommunication means, such as mud pulse telemetry, electromagnetic telemetry, acoustic telemetry, any type of wired communication, any type of wireless communication, or any combination thereof. As described in more detail below, the components 130 may be used to control the vibration and actuation of one or more vibrational devices or other movable elements on or within the drill bit 114 to impart vibrations to the drill bit 114 (e.g., by controlling the amplitude and/or frequency of the vibrations). In some embodiments, components 130 may be used to determine and provide one or more vibrational frequencies for one or more vibrational devices on or within the drill bit 114 based on a bending strain and/or a mechanical torsion strain in the drill string 106, as discussed in further detail hereinafter.

Figure 2:
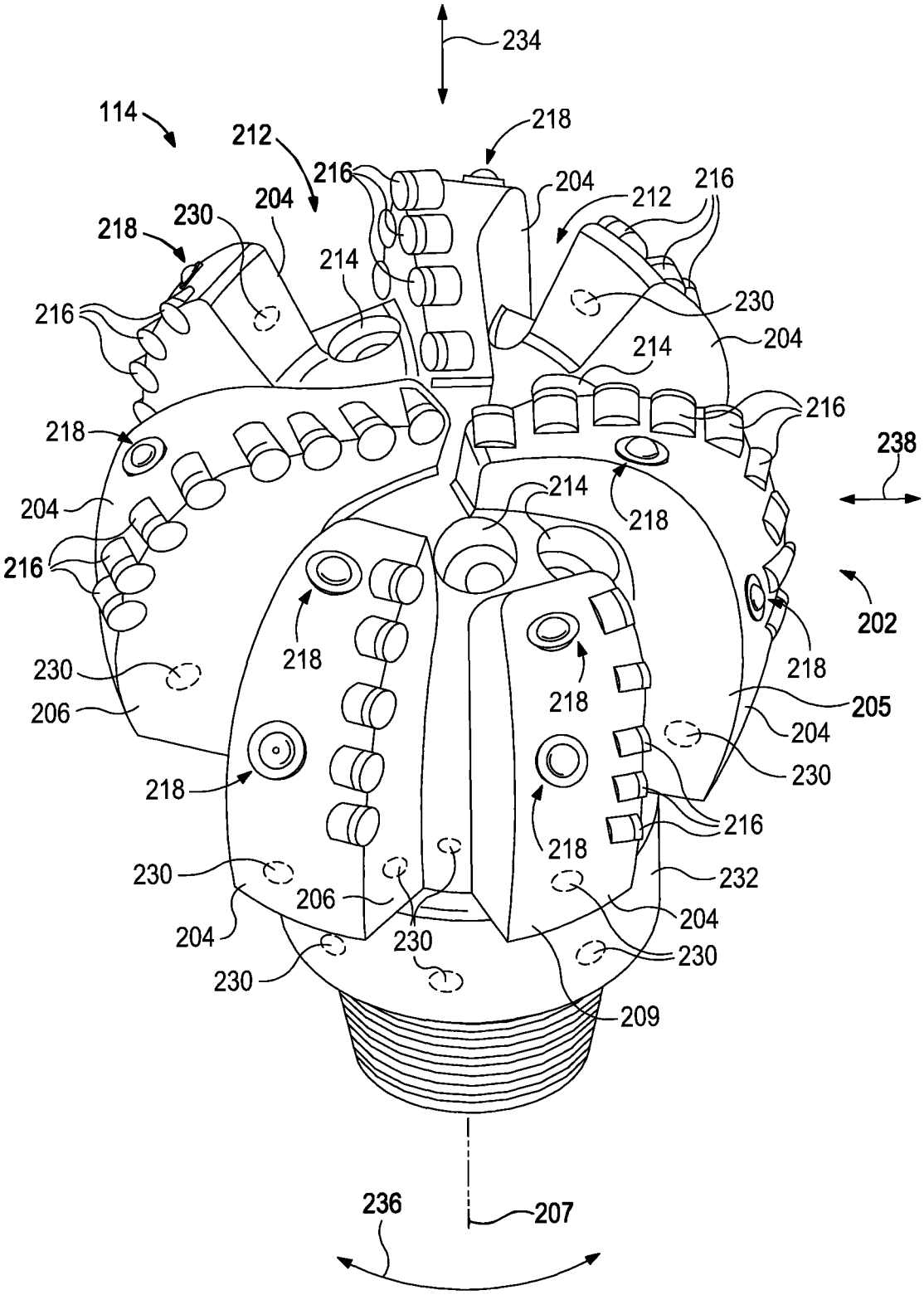
FIG. 2 depicts a drill bit that can employ the principles of the present disclosure.

Referring to FIG. 2, illustrated is an isometric view of a drill bit 114 that may employ the principles of the present disclosure. As depicted by way of example in FIG. 2, a drill bit according to the present teachings may be applied to any of the fixed cutter drill bit categories, including polycrystalline diamond compact (PDC) drill bits, drag bits, matrix drill bits, and/or steel body drill bits. While depicted in FIG. 2 as a fixed cutter drill bit, the principles of the present disclosure are equally applicable to other types of drill bits operable to form a wellbore including, but not limited to, roller cone drill bits and reamers (hole openers).

The drill bit 114 has a bit body 202 that includes radially and longitudinally extending blades 204 having leading faces 206. The bit body 202 may be made of steel or a matrix of a harder material, such as tungsten carbide. The bit body 202 rotates about a longitudinal drill bit axis 207 to drill into a subterranean formation under an applied weight-on-bit. Corresponding junk slots 212 are defined between circumferentially adjacent blades 204, and a plurality of nozzles or ports 214 can be arranged within the junk slots 212 for ejecting drilling fluid that cools the drill bit 114 and otherwise flushes away cuttings and debris generated while drilling.

The bit body 202 further includes a plurality of cutters 216 disposed within a corresponding plurality of cutter pockets sized and shaped to receive the cutters 216. Each cutter 216 in this example is more particularly a fixed cutter, secured within a corresponding cutter pocket via brazing, threading, shrink-fitting, press-fitting, snap rings, or the like. The fixed cutters 216 are held in the blades 204 and respective cutter pockets at predetermined angular orientations and radial locations to present the fixed cutters 216 with a desired back rake angle against the formation being penetrated. As the drill string is rotated, the fixed cutters 216 are driven through the rock by the combined forces of the weight-on-bit and the torque experienced at the drill bit 114. During drilling, the fixed cutters 216 may experience a variety of forces, such as drag forces, axial forces, reactive moment forces, or the like, due to the interaction with the underlying formation being drilled as the drill bit 114 rotates.

As illustrated, the drill bit 114 may further include a plurality of impact arrestors 218 positioned at various locations about the periphery of the drill bit 114. In some embodiments, one or more of the impact arrestors 218 may comprise a ball or ball bearing secured within a housing and configured to roll against the underlying rock and formation during drilling. In other embodiments, one or more of the impact arrestors 218 may be implemented as sliding assemblies configured to slide, rather than roll, against the formation begin penetrated. In embodiments in which the impact arrestors 218 are formed as rolling elements, as in the example of FIG. 2, the impact arrestors 218 may operate as rolling depth of cut control (DOCC) elements. Rolling DOCC elements may prove advantageous in allowing for additional weight-on-bit (WOB) to enhance directional drilling applications without over engagement of the fixed cutters 216. Effective DOCC also limits fluctuations in torque and minimizes stick-slip, which can cause damage to the fixed cutters 216.

In some embodiments, and as discussed in further detail hereinafter, impact arrestors 218 may be actuatable and thereby movable in a direction orthogonal to a tangent to an outer surface of the blade 204 so that the relative height of each impact arrestor 218 can be adjusted (e.g., before and/or during drilling operations). In one embodiment, impact arrestors 218 may be vibratable and thereby movable with respect to the outer surface of the blade 204.

In such embodiments, the impact arrestors 218 may be used as vibration inducing elements for drill bit 114. As mentioned above, the impact arrestors 218 may be employed as a means of controlling the depth of cut of the active cutters 216 of the drill bit 114 and also to reduce impact damage and vibration. According to the present disclosure, one or more impact arrestors 218 may be mounted on the drill bit 114 and actuatable to transition axially a short distance, and thereby create a selectively variable depth of cut. In such embodiments, the impact arrestors 218 may also be operatively coupled to, for example, an actuator such as a piezoceramic actuator, through mechanical, hydraulic or other means so that they can be actuated to induce a low amplitude, high frequency chatter at the interface between the impact arrestor 218 and the formation being drilled. For example, an integrated piezoceramic actuator may be configured to impart vibration to each impact arrestor.

The cutting slope (i.e., helical motion of each cutter 216 during drill bit 114 rotation), along with a desired depth of cut, may determine a desired position for each impact arrestor 218 relative to the cutters 216. Because the cutter exposure varies across the drill bit profile, the position of each impact arrestor 118, the amplitude of vibration of the impact arrestors 218, and/or the frequency of vibration of the impact arrestors 218 may be varied as well.

In scenarios in which impact arrestors 218 are vibrated (e.g., periodically extended and retracted), the impact arrestors 218 may actively engage, in periodic fashion, the surface of the formation being drilled. Vibrational motion of impact arrestors 218 may move the impact arrestors 218 into and out of the corresponding housings with a range of motion that is approximately 10 percent of the full range of DOCC motion of the impact arrestors 218. For example, in one embodiment, an impact arrestor 218 may have a full range of DOCC positions that varies up to approximately 50 thousandths of an inch and may have a vibratory mode with a full range (amplitude) of motion of between four and five thousandths of an inch.

As shown in FIG. 2, drill bit 114 may further include one or more additional vibration inducing elements such as vibrational devices 230. As shown, the vibrational devices 230 may be disposed at various locations about the periphery of the drill bit 114 or within the drill bit 114 at select locations. Vibrational devices 230 may be operatively coupled to the bit body 202 and configured to impart vibrations to the bit body 202 at predetermined frequencies and/or amplitudes. In various embodiments, elements 230 may be attached at or near the outer surface of the bit body 202 or may be partially or completely embedded within the bit body 202. Accordingly, elements 230 may be visible from the outside of the drill bit 114 or may be completely embedded within the drill bit 114, such as within a recess internal to the drill bit 114 or covered by an integral or added cover member to protect the elements 230 from damage during drilling operations.

One or more vibrational devices 230 may be positioned on one or more of blades 204, such as on a leading face 206, a trailing face 205 or along a blade profile 209 of one or more of the blades 204. One or more vibrational devices 230 may also or alternatively be positioned within one or more of the junk slots 212 provided in the bit body 202. In some embodiments, one or more vibrational devices 230 may be positioned on the shank 232 of the drill bit 114. For example, in one embodiment, a plurality of vibrational devices 230 may be equidistantly spaced about the periphery of the shank 232. In various embodiments, vibrational devices 230 may be disposed at equal angular increments around the periphery of drill bit 114 at locations other than the shank 232, such as positioning one or more vibrational devices 230 on each blade 204 and/or in each junk slot 212.

In various embodiments, elements 230 may be molded within the body of drill bit 114 or may be manufactured separately from the drill bit 114 and attached and/or embedded within the drill bit 114 in a secondary manufacturing process. For example, corresponding pockets may be machined into the bit body 202 at select locations and elements 230 may be secured within the pockets, such as through the use of mechanical fasteners, welding, brazing, adhesives, or any combination thereof.

In some embodiments, vibrational devices 230 may be configured to operate independently. In such embodiments, each element 230 may be provided with control circuitry that causes that element to independently vibrate at a particular frequency, at a pre-programmed set of frequencies, or in response to automatic or operator determined real-time frequency control. In some embodiments, two or more of the vibrational devices 230 may be operated in coordination with each other. In such embodiments, the two or more vibrational devices 230 may be configured to vibrate at a particular common frequency, at a pre-programmed set of frequencies, or with automatic or operator determined real-time frequency control.

The energy or power required to actuate or vibrate the vibrational devices 230 may be provided by a common power source located at or near the drill bit 114, along the BHA 104 (FIG. 1), or at a surface location. In some embodiments, one or more batteries or fuel cells may be used to provide power to the vibrational devices 230. Moreover, a centralized control system, such as the computing and communications components 130 of FIG. 1, may be used to operate each vibrational device 230.

Vibrational devices 230 may be operated continuously during drilling operations or may be operated (separately or together) at particular times or while drilling in particular formation types. In some embodiments, one or more sub-groups of vibrational devices 230 may be operated together and operated separately from other sub-groups of vibrational devices 230. Suitable sub-groups of the vibrational devices 230 can include, but are not limited to, the elements 230 located on the blades 204, the elements located on the trailing faces 205 of blades 204, the elements 230 located on the leading faces 206 of blades 204, the elements 230 located on the blade profile 209 of the blades 204, the elements located on shank 232, the elements 230 located within a particular distance or distance range from the crown of the drill bit 114, the elements 230 located within the junk slots 212, and any combination of these.

Vibrational devices 230 may be formed from smart materials such as, but not limited to, piezoceramics, zirconia, and any combination thereof. In operation, an excitation force can be induced via an external stimulus to control the actuation of the vibrational devices 230 so that the elements 230 impart vibrations to the bit body 202 of the drill bit 114. Vibration provided by the vibrational devices 230 may result in discontinuous contact or contact with a discontinuous pressure between the drill bit 114 and the underlying formation being drilled.

Vibrational devices 230 may be positioned and oriented on or within the drill bit 114 such that operation of the elements 230 generates vibratory motion in a particular desired direction with respect to drill bit 114 (e.g., with respect to axis 207 of drill bit 114). For example, one or more elements 230 may be positioned and oriented on or within the drill bit 114 with a direction of actuation (e.g., motion, contraction, or expansion) that is parallel to axis 207 so that operation of those elements 230 induces axial vibrations in the drill bit 114 (e.g., in directions indicated by arrows 234). In another example, one or more elements 230 may be positioned and oriented on or within the drill bit 114 with a direction of actuation that is perpendicular to axis 207 so that operation of those elements 230 induces lateral vibrations in the drill bit 114 (e.g., in directions indicated by arrows 238). In another example, one or more elements 230 may be positioned and oriented on or within the drill bit 114 with a direction of actuation that is tangential to an outer surface of the drill bit 114 (e.g., to blade profile 209 of blades 204) so that operation of those elements induces rotational/circumferential vibrations of drill bit 114 (e.g., in directions indicated by arrows 236).

In various embodiments, vibrational devices 230 may be positioned, oriented, and operated in any suitable combination to induce vibrational motion in any desired direction for the drill bit 114 (e.g., any combination of the directions indicated by arrows 234, 236, and 238). Moreover, co-operation of one or more subgroups of elements 230 at one or a plurality of frequencies may be performed to generate a desired force in a particular angular or axial direction.

Figure 3:
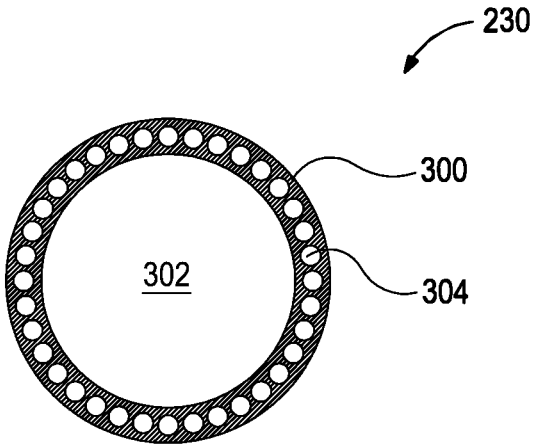
FIG. 3 depicts a cross-sectional view of an exemplary piezoceramic actuator.
Figure 4:
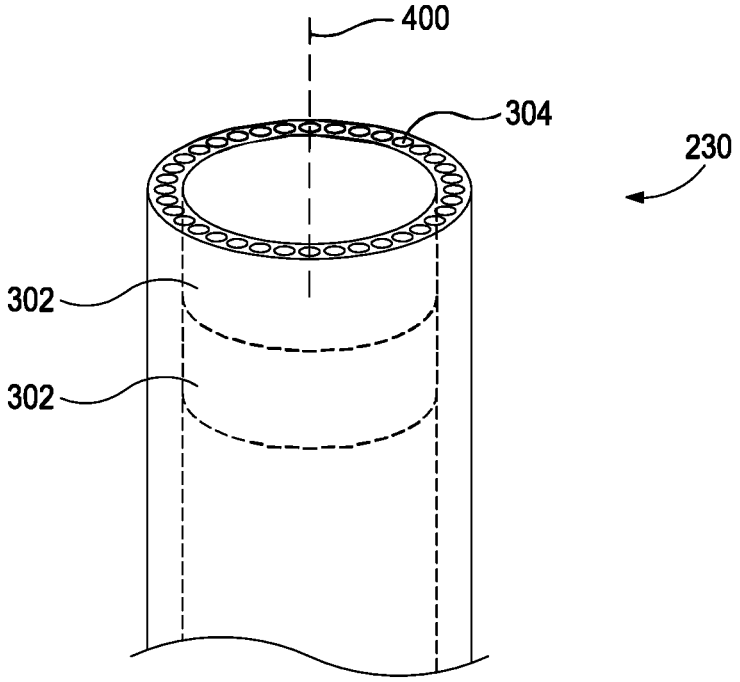
FIG. 4 depicts a perspective view of an exemplary piezoceramic actuator.

In one suitable configuration which is discussed herein as an example, each vibrational device 230 may be formed from one or more piezoceramic actuators. FIGS. 3 and 4 show examples of piezoceramic actuators that may be disposed on or within a drill bit as discussed herein to form a vibrational device 230. FIG. 3 is a cross-sectional view illustrating an exemplary piezoceramic actuator implementation of a vibrational device 230. As shown in the example of FIG. 3, element 230 may include an outer housing 300 that substantially surrounds a disk 302 of piezoelectric material (e.g., lead zirconate titanate (PZT) or other piezoceramic material). One or more conductive elements 304 may be disposed around the disk 302 to provide an electrical signal that causes the disk 302 to contract or expand, thereby generating an actuation that, when element 230 is fixed within a drill bit, such as drill bit 114, causes vibration of the drill bit. Conductive elements 304 may be coupled to a power source, such as a battery, and associated control circuitry at or near the drill bit or may be coupled to a power source and/or control circuitry at or near the surface via a signal line extending through a portion of the drill string.

As shown in the perspective view of FIG. 4, in some embodiments, a vibrational device 230 implemented as a piezoceramic actuator can be formed from a stack of piezoceramic disk elements 302 to provide additional actuation force along the axis 400 of the actuator. It should be appreciated that although disks of piezoceramic materials are shown in FIGS. 3 and 4, in other embodiments annular piezoceramic elements (e.g., elements with a central opening) or piezoceramic elements and associated housings with other cross-sectional shapes (e.g., square, rectangular, oval, etc.) may be used to form vibrational devices 230 as desired.

Piezoceramic actuators as described in connection with FIGS. 3 and 4 can be positioned on or within drill bit 114 (FIG. 2), such as being operatively coupled to the bit body 202 (FIG. 2) with a direction of actuation (e.g., along axis 400) such that actuation of the actuators generates a force in a desired direction with respect to the axis of the drill bit 114.

Figure 5:
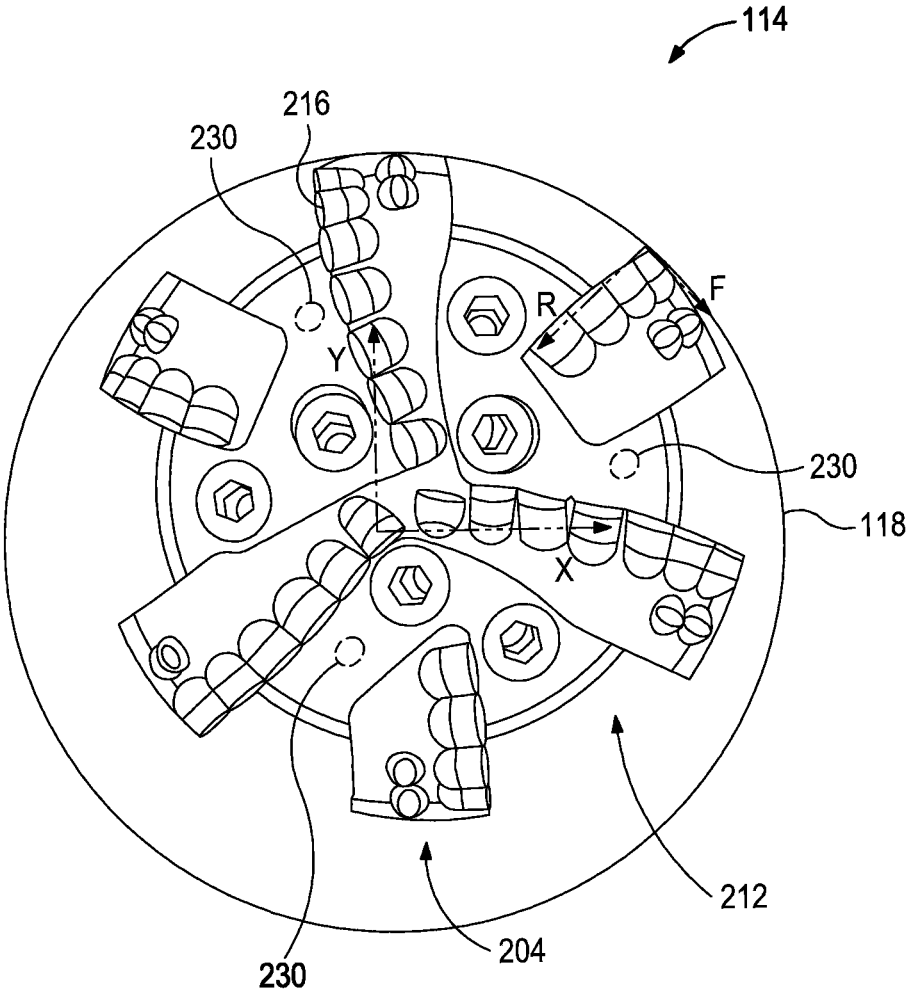
FIG. 5 depicts illustrative forces on a drill bit.

In exemplary operation, as illustrated in FIG. 5, vibrational devices 230, such as piezoelectric actuators, may be operated to provide or otherwise create a regenerative force (F) and/or a restoring force (R) which may urge the drill bit 114 toward the center of the wellbore 118 (the center indicated by the intersection of the x and y axes of FIG. 5).

In order to reduce the backward whirl of the drill bit 114 and/or the drill string 106 (FIG. 1), one or more vibration inducing devices 230 may be positioned at select locations on the drill bit 114 and tuned to induce vibrational motion in the drill bit 114 in the circumferential direction so that backward whirl is reduced. This will result in high lateral contact area at very high frequency. The frequency of vibration may be determined based on an assumption that it is the response of the drill bit 114 to forced motion off its center that causes whirl. One or more vibration inducing devices 230 may be operated to impart energy to the drill bit 114 in, for example, the opposite direction of whirling to oppose the whirling motion.

As will be appreciated, providing a drill bit with vibrational devices 230 as described herein may facilitate providing an anti-stick and/or anti-whirl drill bit that results in generating the point loaded blade friction associated with drill bit movement. While the cutters in PDC bits may be designed to prevent whirl, the presently described vibrational devices 230 may be used instead of, or in addition to, modifying the drill bit. As will be appreciated, urging the drill bit toward the center of the wellbore (e.g., by a restoring force R generated by the vibration inducing elements) may result in the mitigation or elimination of chatter (i.e., vibration) generated by the bit body engaging the walls of the wellbore.

As noted above, unwanted and potentially damaging torsional vibrations can be induced in a drill string due, for example, to stick-slip. In some embodiments, vibration inducting elements 230 (e.g., all vibration inducing elements in the drill bit or one or more sub-sets of the vibrational devices 230 in the drill bit) may be operated to oppose and/or cancel unwanted vibrations, thereby reducing or eliminating damage to the drill string. For example, as further discussed hereinafter, the vibrational energy generated by vibration inducing elements 230 may be tuned, based on a computed bending energy in the drill string 106 (FIG. 1) and/or a computed torsional energy in the drill string 106, to cancel unwanted vibrations in the drill string 106 and, if desired, impart additional vibrations to the formation.

To quantify the complexity of vibration generated by a drill string during drilling, and to further aid in the design of a bottom-hole assembly (BHA) that includes a drill bit, calculations can be performed based on physical reasoning and can be characterized by the amount of strain energy in the drill string due to bending as well as due to mechanical torsion. A calculation of this type will provide the total vibrational energy under bending and torsion, and will also provide additional insight about the severity of vibration when the drill string is under resonant conditions. This methodology puts these two calculations under one quantifiable value to test the susceptibility of the drill string under dynamic conditions and to help determine desired vibrational characteristics of vibration inducing elements 230 for enhancing drilling operations.

The strain energy $U_b$ in a drill string due to bending can be given with the bending rigidity of the component as:

$$U_b = \int_0^l \frac{M(x)^2}{2E(x)I(x)}dx = \frac{E(x)I(l)}{2}\int_0^l \left(\frac{d^2y}{dx^2}\right)^2 dx \qquad \text{Equation (1)}$$

where E(x)I(x) is the bending stiffness, I is the moment of inertia, and M(x) is the moment. This strain energy $U_b$ due to bending can be normalized to the course length of the well as:

$$U_{bn} = \frac{\int_0^\ell \frac{M(x)^2}{2E(x)I(x)}dx}{D_n + \Delta D_n} \qquad \text{Equation (2)}$$

where $D_n$ is the depth at a particular survey station, and $\Delta D_n$ is the incremental depth.

Since the calculated normalized value $U_{bn}$ is in the form of bending stress, Equation (2) can be written as:

$$U_{bn} = \frac{\int_0^\ell \frac{\sigma(x)^2 I(x)}{2E(x)r^2}dx}{D_n + \Delta D_n} \qquad \text{Equation (3)}$$

where r is the pipe radius of the drill string, σ is the stress, I(x) is the moment of inertia, and E(x) is the Young's modulus. The strain energy due to mechanical torsion can be given with the torsion rigidity of the component as:

$$U_t = \int_0^\ell \frac{T(x)^2}{2G(x)J(x)}dx = \frac{G(x)J(x)}{2}\int_0^\ell \left(\frac{d^2y}{dx^2}\right)^2 dx \qquad \text{Equation (4)}$$

where G(x)J(x) is the torsional stiffness T(x) is the torque, G(x) is the shear modulus, and J(x) is the polar moment of inertia.

The strain energy $U_t$ due to torsion can also be normalized to the course length of the well as:

$$U_{tn} = \frac{\int_0^\ell \frac{T(x)^2}{2G(x)J(x)}dx}{D_n + \Delta D_n} \qquad \text{Equation (5)}$$

Similarly, as in Equation (3), Equation (5) for the normalized strain energy due to torsion $U_{tn}$ can be written as:

$$U_{tn} = \frac{\int_0^\ell \frac{\tau(x)^2 J(x)}{2G(x)r^2}dx}{D_n + \Delta D_n} \qquad \text{Equation (6)}$$

where r is the pipe radius and τ is the torsion. A comprehensive analysis can be performed using both bending and torsional energies as:

$$U_{(abs)_n} = \left(\frac{\sum_{i=1}^{n}(U_{bi}^2 + U_{ti}^2)\Delta D_i}{D_n + \Delta D_n}\right) \qquad \text{Equation (7)}$$

The estimation of the value $U_{(abs)n}$ using Equation (7) indicates how much the drill string is subjected to energy loss during vibration. The lower the value of $U_{(abs)n}$ derived from the above calculations, the lower the vibration intensity will be and thus the higher the stability of the drill string. In some situations, Equation (5) can also be modified to include the strain energy due to direct as well as transverse shear and axial loading if desired. Other strain energies may be neglected so that the above calculations can be combined with the wellbore profile energy consideration, as described below.

Figure 6A:
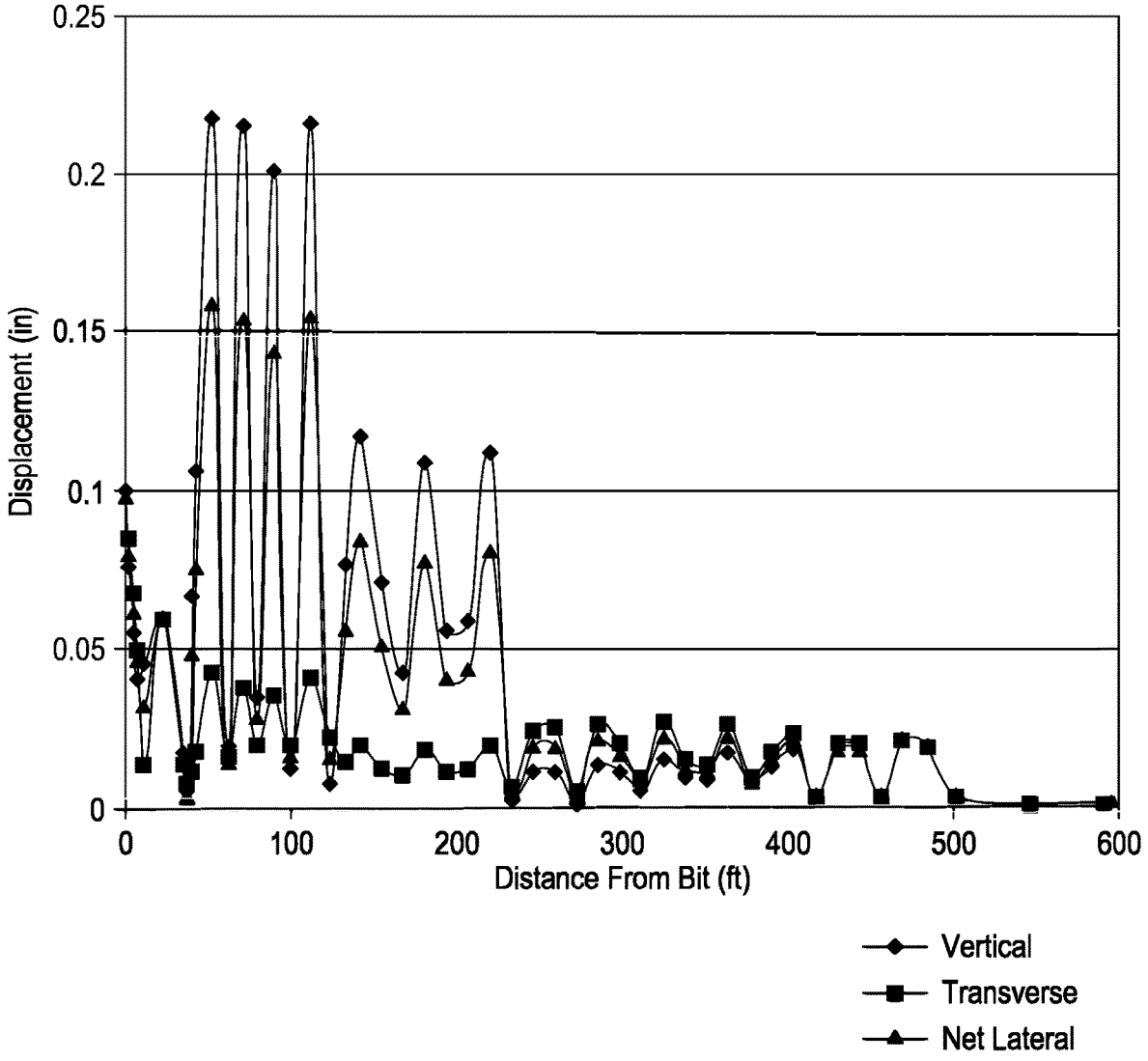
FIGS. 6A and 6B depict graphs showing displacement as a function of distance from the bit for drilling systems respectively with and without vibrational energy imparted to the bit.
Figure 6B:
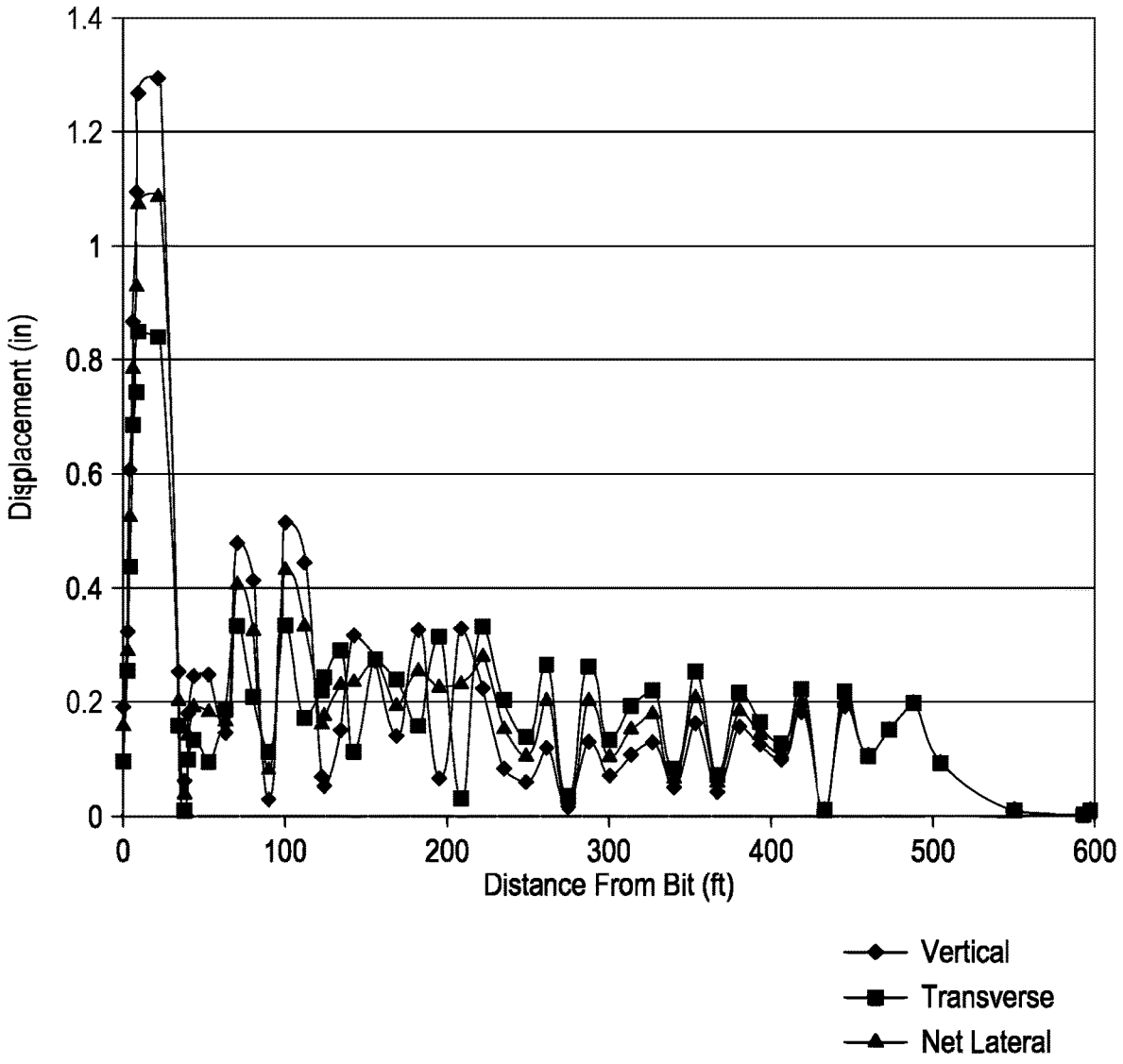

As further described below, the energy $U_{(abs)n}$ can be used to determine a desired input vibrational energy such as a piezoceramic energy when used. FIGS. 6A and 6B show examples of vibrational displacements in the drill string as a function of the distance from the bit respectively with and without induced vibration using one or more vibration inducing elements such as a piezoceramic modular sub. More particularly, FIG. 6A shows the resulting displacement in an application that includes energy provided by one or more vibration inducing elements, and FIG. 6B shows the resulting displacement in an application that omits the energy provided by vibration inducers.

In each of FIGS. 6A and 6B, three curves are shown including a "Vertical X" curve which describes the vertical displacement, a "Transverse" curve which describes the transverse displacement, and a "Net Lateral" curve which describes the resultant of the components in all other directions. As can be seen by comparing FIGS. 6A and 6B, the displacement at all distances is significantly smaller (e.g., up to a factor of 4-5 or more smaller) with an induced vibration than without. Moreover, the Vertical X, Transverse, and Net Lateral displacements are substantially in phase at all distances with the input vibrations which may further reduce damage to the bit string.

In order to quantify further the severity of the vibration on the BHA design as well as the use of various operating parameters, both well path energy and the strain energy due to string vibration can be related as in Equation (8) below:

$$E_d = \frac{E_{(abs)_n}}{U_{(abs)_n}} = \frac{(peizoenergy)}{\left(\frac{\sum_{i=1}^{n}(U_{bi}^2 + U_{ti}^2)\Delta D_i}{D_n + \Delta D_n}\right)} \quad \text{Equation (8)}$$

where $E_{(abs)n}$ is the energy imparted by one or more vibration inducing elements such as a "piezoenergy" imparted by one or more piezoceramic actuators. Thus a value $E_d$ can be determined that is the ratio of the imparted vibrational energy to the unwanted vibrational energy in the string. A vibration intensity (VI) can be determined to help to estimate the critical speeds and eliminate less intense speeds, which are less harmful and to provide a reasonable method of normalizing the intensity at various rotational speeds. The vibration intensity (VI) may be defined as the ratio of the peak of relative parameters such as stresses, displacements, forces, moments and phase angle, to the nearby value of the parameters prior to the peak resonant value (e.g., at the next closest resonant value to the peak). At the peaks, the solution at which the rotational speed coincides with the critical speed has no solution and the matrix of the coefficients becomes singular. Using the vibration intensity factor, weak forms of amplitude of vibration or stresses, displacements, or forces can be eliminated and bit or string rotational speeds, which are weak in another estimator, can be included.

Accordingly, vibration intensity (VI) may be calculated as follows:

$$VI = \frac{E_d}{E_{d(peak)}} \quad \text{Equation (9)}$$

where $E_d$ is the value of the ratio in Equation (8) at piezoenergy to string energy and $E_{d(peak)}$ is the value of the ratio in Equation (8) at the peak.

Vibration inducing elements such as vibrational devices 230 and/or impact arrestors 218 may be operated with a suitable direction, orientation, and frequency to be able to adjust the rotation/frequency so that the vibrational intensity VI becomes unity or, in other words, $E_d$ becomes equal to $E_{d(peak)}$. In the case that VI=1, the vibrations of the vibrational devices 230 substantially absorb all of the unwanted energy in the drill string 106 (FIG. 1). For values of VI less than 1, more energy is transmitted to the drill string 106 and for values of VI greater than 1, greater energy is transmitted to the formation. In at least one embodiment, the ratio VI should thus be substantially equal to 1 or greater than 1. In other words, the vibration frequency of the vibrational devices 230 should be adjusted so that VI becomes 1 or greater than 1.

In some embodiments, the vibrational devices 230 may be adjusted automatically, such as by setting the vibrational frequency of each element 230 based on determined real-time bending and mechanical torsion energies to set the vibrational intensity to a value of one or greater than 1. To accomplish this, a computer processor or firmware, such as computing and communications components 130 of FIG. 1, may be used to determine desired frequencies for one or more vibrational devices 230 and to send control signals to the vibrational devices 230. As discussed herein, vibrational devices 230 positioned on or within a drill bit may be operated at a common frequency, at individual frequencies, or in groups in which each vibrational device 230 in a group is vibrated at a common frequency. The relationship of the phase angle φ to the maximum amplitude of the various parameters can be related by Equation (9) above, and can also be used to determine the desired vibrational frequencies.

Figure 7:
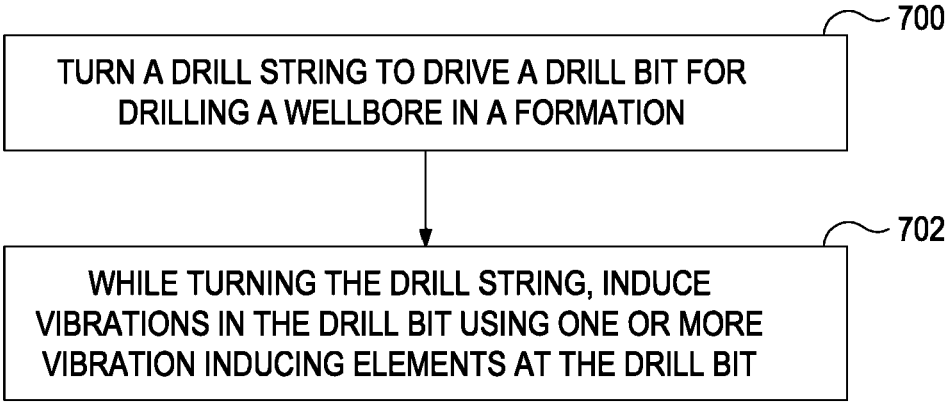
FIG. 7 depicts a flow chart of illustrative operations that may be performed for operating a drilling system having a drill bit with vibrational devices.

FIG. 7 is a schematic flowchart of a method of operating a drilling system having a drill bit with vibration inducing elements, according to one or more embodiments of the present disclosure. At block 700, a drill string (e.g., drill string 106 of FIG. 1) may be turned to drive a drill bit (e.g., drill bit 114 of FIGS. 1 and 2) for drilling a wellbore in a formation.

At block 702, while turning the drill string, vibrations may be induced in the drill bit using one or more vibration inducing elements, such as one or more vibrational devices (e.g., piezoceramic actuators) positioned on the drill bit. For example, the vibrational devices may be positioned on or within the drill bit (e.g., on or within the bit body 202 of FIG. 2) at various locations, as described herein, and may be vibrated at suitable vibration frequencies and/or amplitudes for imparting vibrations to the bit body. The vibrations imparted to the bit body may induce chattering of the drill bit relative to the formation and/or may counteract unwanted whirl in the drill string. Inducing vibrations may be effected through the use of computing equipment at a BHA 104 (FIG. 1), for example, or at a surface location in communication with the BHA 104. Inducing vibrations may include determining vibration frequencies for one or more integrated vibrational devices in the drill bit based on a bending strain and a mechanical torsion strain of the drill string as described herein and operating the vibrational devices at the determined vibration frequencies.

Figure 8:
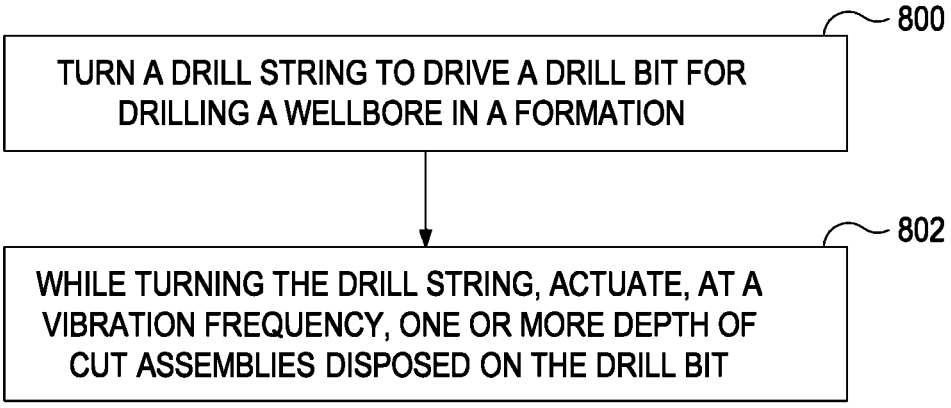
FIG. 8 depicts a flow chart of illustrative operations that may be performed for operating a drilling system having a drill bit with vibratable depth of cut control components in accordance with an embodiment of the present disclosure.

FIG. 8 is a schematic flowchart of a method of operating a drilling system having a drill bit with impact arrestors, according to one or more embodiments of the present disclosure. At block 800, a drill string (e.g., drill string 106 of FIG. 1) may be turned to drive a drill bit such as drill bit 114 for drilling a wellbore in a formation.

At block 802, while turning the drill string, one or more vibration inducing elements such as one or more impact arrestors 218 (FIG. 2) positioned on the drill bit may be actuated at a predetermined vibration frequency. In some embodiments, the one or more impact arrestors 218 may be actuated with an amplitude of less than (for example) 10 percent of a full range of motion of the impact arrestors 218 and with a frequency and/or amplitude determined based on the position of the impact arrestors 218 on the drill bit. In some embodiments, the impact arrestors 218 may be vibrated using corresponding vibrational devices, such as piezoceramic actuators, mechanically or hydraulically coupled to the impact arrestors 218.

Although the examples of FIGS. 7 and 8 are described in the context of a drill bit driven by a drill string rotated from the surface as in the example drilling system of FIG. 1, it will be appreciated that the vibration inducing operations of blocks 702 and 802 may be performed while drilling with a drill bit driven additionally or alternatively by a downhole motor or other drive mechanism.

Embodiments disclosed herein include:

A. A drill bit that includes a bit body, one or more cutters positioned on the bit body, and at least one vibrational device positioned on the bit body to impart vibration to the bit body.

B. A method that includes rotating a drill bit coupled to an end of a drill string and thereby drilling a wellbore through one or more subterranean formations, actuating a vibrational device positioned on the drill bit and thereby imparting vibration to the drill bit, and mitigating at least one of stick-slip of the drill bit and whirl of the drill string with the vibration imparted by the vibrational device.

C. A drilling system that includes a drill string extendable within a wellbore drilled through one or more subterranean formations, a drill bit coupled to an end of the drill string and including a bit body and one or more cutters positioned on the bit body, and at least one vibrational device positioned on the bit body to impart vibration to the bit body.

Each of embodiments A, B, and C may have one or more of the following additional elements in any combination: Element 1: wherein the at least one vibration inducing element comprises a piezoceramic actuator. Element 2: wherein a frequency of the vibration imparted by the at least one vibration inducing element is between 100 Hz and 1000 Hz. Element 3: wherein a frequency of the vibration imparted by the at least one vibration inducing element is ultrasonic. Element 4: wherein the vibration imparted by the at least one vibration inducing element is tuned in a circumferential direction with respect to the bit body. Element 5: further comprising at least one actuatable impact arrestor positioned on the bit body. Element 6: wherein the at least one actuatable impact arrestor is operatively coupled to a piezoceramic actuator positioned to actuate the impact arrestor. Element 7: wherein the at least one vibration inducing element comprises an additional piezoceramic actuator operatively coupled to the bit body.

Element 8: wherein the vibrational device comprises a vibration inducing element positioned on a bit body of the drill bit, and wherein actuating the vibrational device comprises operating the vibration inducing element to generate chattering of the bit body with respect to the one or more subterranean formations. Element 9: wherein the vibrational device comprises a vibration inducing element, and wherein actuating the vibrational device comprises operating the vibration inducing element to counteract torsional vibrations in the drill string. Element 10: wherein the vibrational device comprises a vibration inducing element, and wherein actuating the vibrational device comprises operating the vibration inducing element to urge the drill bit to the center of the wellbore. Element 11: wherein the vibrational device comprises an impact arrestor, and wherein actuating the vibrational device comprises actuating the impact arrestor to induce a low amplitude, high frequency chatter at an interface between the impact arrestor and the one or more subterranean formations being drilled. Element 12: wherein actuating the impact arrestor comprises operating a piezoceramic actuator operatively coupled to the impact arrestor. Element 13: wherein actuating the impact arrestor comprises actuating the impact arrestor with an amplitude of motion that is based on a position of the impact arrestor as mounted to a bit body of the drill bit. Element 14: wherein the impact arrestor exhibits a range of motion and wherein actuating the impact arrestor comprises actuating the impact arrestor with an amplitude of motion that is less than ten percent of the range of motion.

Element 15: further comprising computing equipment configured to determine a vibration frequency for the at least one vibrational device based on a bending strain and a mechanical torsion strain of the drill string. Element 16: wherein the at least one vibrational device comprises a plurality of piezoceramic actuators positioned at various locations on the bit body. Element 17: wherein the at least one vibrational device comprises at least one actuatable impact arrestor positioned on the bit body.

By way of non-limiting example, exemplary combinations applicable to A, B, and C include: Element 5 with Element 6; Element 6 with Element 7; Element 11 with Element 12; Element 11 with Element 13; and Element 11 with Element 14.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A method, comprising:

rotating a drill bit coupled to an end of a drill string and thereby drilling a wellbore through one or more subterranean formations;

actuating a vibrational device positioned on the drill bit and thereby imparting vibration to the drill bit, wherein the vibrational device is positioned on a bit body of the drill bit, and wherein actuating the vibrational device comprises operating the vibrational device to generate chattering of the bit body with respect to the one or more subterranean formations; and mitigating at least one of stick-slip of the drill bit and whirl of the drill string with the vibration imparted by the vibrational device.

2. The method of claim 1, wherein actuating the vibrational device comprises operating the vibrational device to counteract torsional vibrations in the drill string.

3. The method of claim 1, wherein the actuating the vibrational device comprises operating the vibrational device to urge the drill bit to the center of the wellbore.

4. The method of claim 1, wherein actuating the vibrational device comprises operating a piezoceramic actuator.

5. The method of claim 1, wherein the vibrational device comprises an impact arrestor, and wherein actuating the vibrational device comprises actuating the impact arrestor to induce chatter at an interface between the impact arrestor and the one or more subterranean formations being drilled.

6. The method of claim 5, wherein actuating the impact arrestor comprises operating a piezoceramic actuator operatively coupled to the impact arrestor.

7. The method of claim 5, wherein actuating the impact arrestor comprises actuating the impact arrestor with an amplitude of motion that is based on a position of the impact arrestor as mounted to a bit body of the drill bit.

8. The method of claim 5, wherein the impact arrestor exhibits a range of motion and wherein actuating the impact arrestor comprises actuating the impact arrestor with an amplitude of motion that is less than ten percent of the range of motion.

9. The method of claim 1, wherein actuating the vibrational device comprises operating the vibrational device at a vibration frequency between 100 Hz and 1000 Hz.

10. The method of claim 1, wherein actuating the vibrational device comprises operating the vibrational device at an ultrasonic vibration frequency.

11. A method, comprising:

rotating a drill bit coupled to an end of a drill string and thereby drilling a wellbore through one or more subterranean formations, wherein the drill bit comprises a bit body with radially and longitudinally extending blades;

actuating a plurality of vibrational devices comprising a first vibrational device and a second vibrational device, wherein the first vibrational device is at least partially embedded within the radially and longitudinally extending blades, wherein an orientation of the first vibrational device is configured to impart vibration to the bit body to urge the bit body to move in a circumferential direction, and wherein the second vibrational device is at least partially embedded within the bit body, wherein an orientation of the second vibrational device is configured to impart vibration to the bit body to urge the drill bit to move in a direction toward a center of a wellbore, and wherein each vibrational device of the plurality of vibrational devices includes a control circuit to independently control a vibration frequency of the respective vibrational device such that each vibrational device of the plurality of vibrational devices operates at a respective vibration frequency while actuating, wherein the respective vibration frequency is based on a bending strain and a mechanical torsion strain of the drill string mitigating at least one of stick-slip of the drill bit and whirl of the drill string with movement induced by the vibration imparted by the plurality of vibrational devices.

12. The method of claim 11, wherein actuating the plurality of vibrational devices comprises operating a corresponding piezoceramic actuator of each vibrational device of the plurality of vibrational devices.

13. The method of claim 12, wherein each piezoceramic actuator includes an outer housing surrounding a disk of piezoelectric material and at least one conductive element extending axially through the outer housing, the at least one conductive element electrically coupled to the control circuit.

14. The method of 13, wherein actuating the plurality of vibrational devices with control circuit to independently control a vibration frequency of each respective vibrational device such that each respective vibrational device of the plurality of vibrational devices operates at a respective vibration frequency includes outputting respective electrical signals from the control circuit to the corresponding at least one conductive element of each respective vibrational device.

15. The method of claim 13, wherein the disk of piezoelectric material is configured to contract or expand in response to an electrical signal to provide an actuation force along an axis of the piezoceramic actuator.

16. A method, comprising:

rotating a drill bit coupled to an end of a drill string and thereby drilling a wellbore through one or more subterranean formations, wherein the drill bit comprises a bit body with radially and longitudinally extending blades;

actuating a plurality of vibrational devices comprising a first vibrational device and a second vibrational device, wherein the first vibrational device is at least partially embedded within the radially and longitudinally extending blades, wherein an orientation of the first vibrational device is configured to impart vibration to the bit body to urge the bit body to move in a circumferential direction, and wherein the second vibrational device is at least partially embedded within the bit body, wherein an orientation of the second vibrational device is configured to impart vibration to the bit body to urge the drill bit to move in a direction toward a center of a wellbore, and wherein each vibrational device of the plurality of vibrational devices includes one or more conductive disk elements, wherein a first set of conductive disk elements of the first vibrational device are stacked and a second vibrational set of conductive disk elements of the second vibrational devices are stacked to exert respective forces along respective axes of the first vibrational devices and the stacked second set of vibrational devices to generate chattering of the bit body with respect to the one or more subterranean formation, and wherein each vibrational device of the plurality of vibrational devices comprises at least one respective actuatable impact arrestor, and wherein actuating each vibrational device comprises actuating the respective impact arrestor to induce chatter at an interface between the respective impact arrestor and the one or more subterranean formations being drilled; and mitigating at least one of stick-slip of the drill bit and whirl of the drill string with movement induced by the vibration imparted by the plurality of vibrational devices.

17. The method of claim 16, wherein the plurality of vibrational devices comprises a plurality of piezoceramic actuators positioned at various orientations, wherein the various orientations include a first orientation, a second orientation, a third orientation, or some combination thereof, and wherein first orientation is configured to direct the respective forces from plurality of vibrational devices in a direction perpendicular to a central axis of the drill bit, the second orientation is configured to direct the respective forces from plurality of vibrational devices in a direction parallel to the central axis of the drill bit, and the third orientation is configured to direct the respective forces from plurality of vibrational devices in a direction tangential to an outer surface of the drill bit.

18. The method of claim 16, wherein the bit body further comprises at least one junk slot, and wherein the second vibrational device is at least partially embedded within the at least one junk slot.

19. The method of claim 16, wherein the bit body further comprises a shank, and wherein the second vibrational device is at least partially embedded within the shank.

20. The method of claim 16, wherein each vibrational device comprises at least one piezoceramic actuator configured to actuate the respective impact arrestor, and wherein the at least one piezoceramic actuator is mechanically or hydraulically coupled to the respective impact arrestor.

* * * * *